US006938788B2

(12) United States Patent
White

(10) Patent No.: US 6,938,788 B2
(45) Date of Patent: Sep. 6, 2005

(54) SQUEEZABLE BEVERAGE BOTTLE

(75) Inventor: Jeremy W. White, Barrington, IL (US)

(73) Assignee: Stokley-Van Camp, Inc., Chicago, IL (US)

( * ) Notice: Subject to any disclaimer, the term of this patent is extended or adjusted under 35 U.S.C. 154(b) by 159 days.

(21) Appl. No.: 10/374,745

(22) Filed: Feb. 25, 2003

(65) Prior Publication Data

US 2004/0164047 A1 Aug. 26, 2004

(51) Int. Cl.[7] ..... B65D 1/02; B65D 23/10

(52) U.S. Cl. ..... 215/384; 215/381; 215/398; 215/400; 220/666; 220/673; 220/675

(58) Field of Search ..... 215/382–384, 215/396, 398, 379, 900; 220/672, 673, 755, 771, 666, 669

(56) References Cited

U.S. PATENT DOCUMENTS

| | | | | | |
|---|---|---|---|---|---|
| 2,022,520 | A | * | 11/1935 | Philbrick | 215/384 |
| 3,297,194 | A | * | 1/1967 | Caldwell et al. | 220/672 |
| 3,335,902 | A | * | 8/1967 | Javorik | 220/673 |
| 4,512,490 | A | * | 4/1985 | Frei et al. | 220/673 |
| 4,708,254 | A | * | 11/1987 | Byrns | 215/13.1 |
| 4,805,788 | A | | 2/1989 | Akiho | |
| 4,863,046 | A | | 9/1989 | Collette et al. | |
| 5,080,244 | A | * | 1/1992 | Yoshino | 215/375 |
| 5,092,475 | A | | 3/1992 | Krishnakumar et al. | |
| 5,201,438 | A | | 4/1993 | Norwood | |
| 5,303,834 | A | | 4/1994 | Krishnakumar et al. | |
| 5,472,105 | A | | 12/1995 | Krishnakumar et al. | |
| 5,632,397 | A | | 5/1997 | Fandeux et al. | |
| 5,637,167 | A | | 6/1997 | Krishnakumar et al. | |
| 5,690,244 | A | | 11/1997 | Darr | |
| 5,729,794 | A | | 3/1998 | Schwallie et al. | |
| 5,746,339 | A | | 5/1998 | Petre et al. | |
| D411,740 | S | | 6/1999 | Kim | |
| 5,908,128 | A | | 6/1999 | Krishnakumar et al. | |
| 5,971,184 | A | | 10/1999 | Krishnakumar et al. | |
| 6,044,996 | A | * | 4/2000 | Carew et al. | 215/381 |
| 6,065,624 | A | * | 5/2000 | Steinke | 215/383 |
| 6,095,360 | A | * | 8/2000 | Shmagin et al. | 215/382 |
| 6,189,724 | B1 | * | 2/2001 | Lin | 220/674 |
| 6,223,932 | B1 | | 5/2001 | Usui | |
| 6,230,912 | B1 | * | 5/2001 | Rashid | 215/383 |
| 6,612,451 | B2 | * | 9/2003 | Tobias et al. | 215/375 |
| 6,695,163 | B2 | * | 2/2004 | Michalowski | 215/398 |
| 2002/0008077 | A1 | | 1/2002 | Lane et al. | |
| 2002/0148841 | A1 | | 10/2002 | Elich et al. | |

FOREIGN PATENT DOCUMENTS

| | | | | |
|---|---|---|---|---|
| GB | 2250259 A | * | 6/1992 | B65D/1/02 |
| WO | WO 01/89934 | | 11/2001 | |

OTHER PUBLICATIONS

PCT/US2004/005403—International Search Report and the Written Opinion of the International Searchig Authority, dated Jul. 30, 2004.

Declaration of Inventor Jeremy White, dated Jun. 24, 2004, regarding prior bottle concept of Sep. 2002.

* cited by examiner

*Primary Examiner*—Sue A. Weaver
(74) *Attorney, Agent, or Firm*—Cook, Alex, McFarron, Manzo, Cummings & Mehler, Ltd.

(57) ABSTRACT

A squeezable bottle is provided that has a hollow body with an intermediate panel section that is bounded by upper and lower recessed reinforcing rings. The intermediate panel comprises a plurality of recessed gripper rings, each of which is bounded by a pair a raised reinforcing rings. A plurality of recessed vertical ribs extends between the upper and lower recessed reinforcing rings and through the raised reinforcing rings. The vertical ribs are spaced asymmetrically about the vertical axis of the bottle.

4 Claims, 2 Drawing Sheets

SQUEEZABLE BEVERAGE BOTTLE

BACKGROUND OF THE INVENTION

The present invention relates to a beverage bottle that is squeezable and, more particularly, to a beverage bottle that, while being squeezable, also has sufficient radial rigidity to permit hot-filling of the bottle and to prevent damage or deformation to the bottle during its handling.

Squeezable beverage bottles, though initially used primarily by bicyclists and other athletes, are now widely used primarily due to the increasing consumption of sports beverages. Such bottles are typically sized to be easily held in one hand and contain a serving size suitable for a single person. The bottle includes a recloseable valve at the top sized to be held between the consumer's lips, through which the beverage is discharged by squeezing the bottle.

There has been a proliferation of different squeeze bottle designs. However, the desire to have a bottle that is relatively easy to squeeze by the consumer in manner to control the rate at which the beverage is dispensed through the valve conflicts with the need to have a bottle that has sufficient radial rigidity—or resistance to squeezing—to withstand the rigors of filling, shipping, dispensing, etc. Specifically, the bottles are typically filled in a hot-filling operation, where the bottles are filled and hermetically sealed with liquid above ambient temperature, yet stored at ambient or refrigerated temperatures. This causes the liquid and gas headspace to contract in volume after the sealing of the bottle. Consequently, the pressure in the bottle is lower than ambient pressure, resulting in a vacuum force that tends to collapse the bottle. Additional vacuum is created during long-term storage due to the permeation of water vapor to the bottle interior. Thus, the bottles need to resist collapse due to this vacuum pressure.

Accordingly, it is an object for the present invention to provide a beverage bottle whose contains are to be dispensed by squeezing the bottle that is both relatively easy of the user to squeeze and also have sufficient radial rigidity to resist damage and/or undesired deformation.

SUMMARY OF INVENTION

This object, as well as others that will become apparent upon reference to the following detailed description and accompanying drawings are accomplished by a squeezable bottle that has a hollow body with an intermediate panel section that is bounded by upper and lower recessed reinforcing rings. The intermediate panel comprises a plurality of recessed gripper rings, each of which is bounded by a pair a raised reinforcing rings. A plurality of recessed vertical ribs extends between the upper and lower recessed reinforcing rings and through the raised reinforcing rings. The vertical ribs are spaced asymmetrically about the vertical axis of the bottle. In a preferred embodiment, there is an odd number of vertical ribs which are equally spaced about the circumference of the bottle. In the disclosed embodiment, there are seven vertical ribs and four gripper rings.

DETAILED DESCRIPTION

Figure 1:
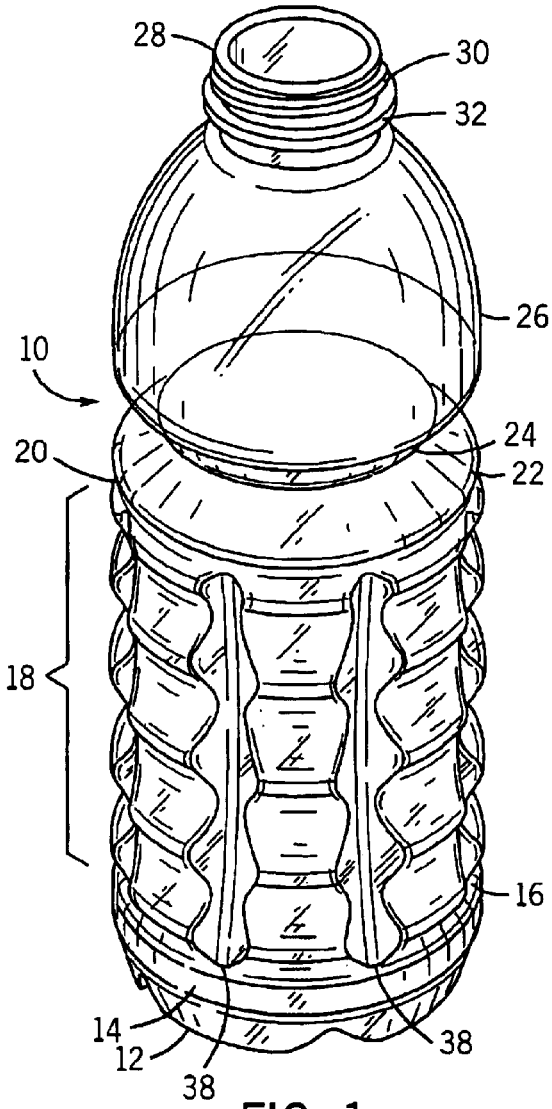
FIG. 1 is a perspective view of squeezable bottle according to the present invention.
Figure 4:
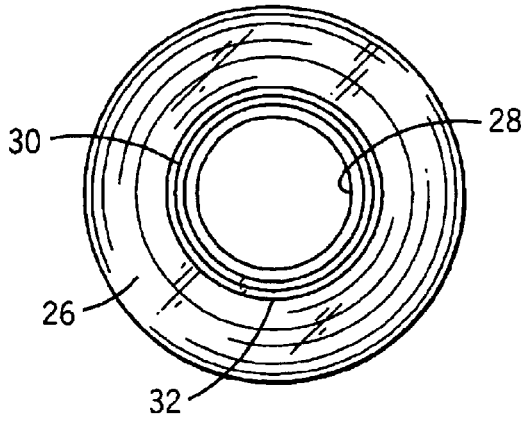
FIG. 4 is a top view of the bottle of FIG. 1.
Figure 5:
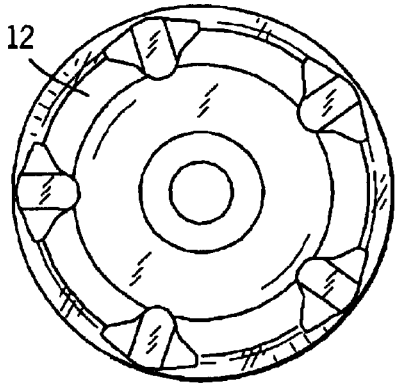
FIG. 5 is a bottom view of the bottle of FIG. 1.

Turning to the drawings, there is seen in FIG. 1 a perspective view of a squeezable bottle 10 according to the present invention. The bottle is preferably made from PETE by blow molding in the well known manner.

The bottle 10 includes a base 12 that is segmented and recessed for additional strength. Above the base 12 is a radial, outwardly-projecting lower bumper 14 and a radial, recessed ring 16. Directly above the recessed ring 16 is a an inventive panel section, generally designated 18, which will be described in detail below.

Above the panel section 18 is an upper recessed ring 20 and outwardly projecting bumper 22, similar to the lower recessed ring 16 and bumper 14. Above the bumper 22 is a recessed circumferential ring 24, which defines the lower the edge of tapered shoulder or dome section 26.

The upper end of the bottle 10 terminates in a neck finish 28 with outer threads 30 for receiving a removable screw cap (not shown) and a neck flange 32. The screw cap typically includes an internally threaded base portion that engages the outer threads 30 on the neck finish 28. The upper end of the cap terminates in a nozzle that is manipulated by the consumer to move between open and closed positions. See e.g., U.S. Pat. Nos. 4,967,941, 6,338,425, Des. 402,899, and Des. 405,693, which are incorporated by reference herein.

Beverage is dispensed from the bottle 10 when the nozzle is opened and the side wall of the bottle squeezed to create an internal pressure on the liquid contents. The rate at which the beverage is dispensed from the bottle depends on the degree to which pressure is created on the contents through squeezing the sidewalls. Thus, it is desirable that the side be configured to permit easy, controllable deformation by squeezing with one hand. However, the sidewalls must also be sufficiently rigid and resistant to deformation so as to withstand the vacuum created by hot-filling and rough handling that may occur during manufacture, shipping and dispensing.

Consequently, in keeping with the present invention, the panel section 18 is uniquely configured to satisfy these conflicting design criteria. The panel section 18 includes a plurality of recessed circumferential rings 34*a–d* located between the lower recessed ring 16 and upper recessed ring 20. Raised rings 36*a–e* bound each ring 34*a–d*.

Each of the recessed rings 34*a–d* is configured to comfortably seat one human finger so that the bottle can be firmly gripped in one hand by the consumer. As shown, there are four recessed gripping rings 34*a–d*, one gripper ring for each finger. However, different numbers of gripping rings can be used without departing from the present invention.

Figure 6:
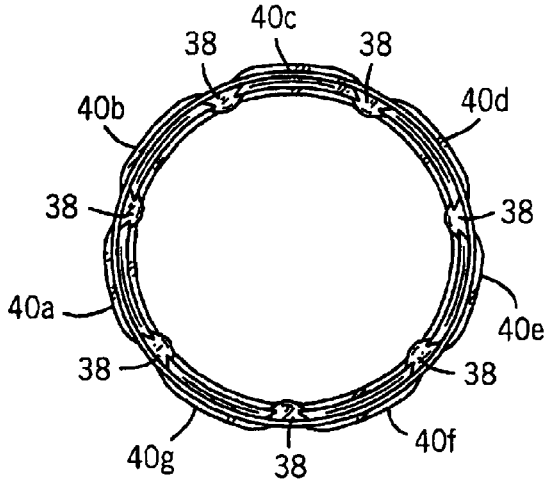
FIG. 6 is cross-sectional view taken along lines 6—6 of FIG. 2.
Figure 2:
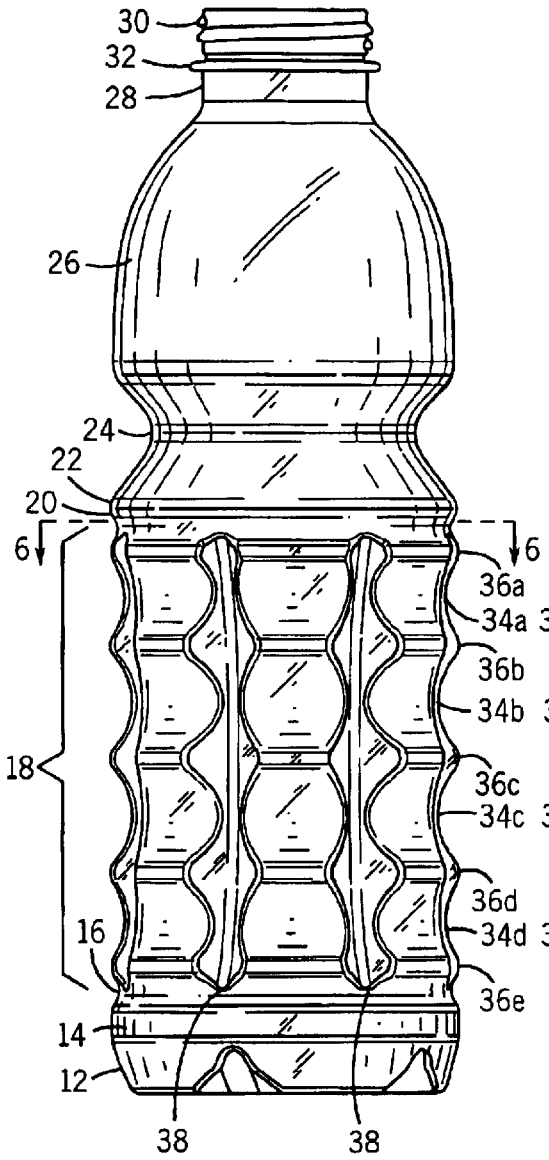
FIG. 2 is an elevational view of the squeezable bottle shown in FIG. 1.
Figure 3:
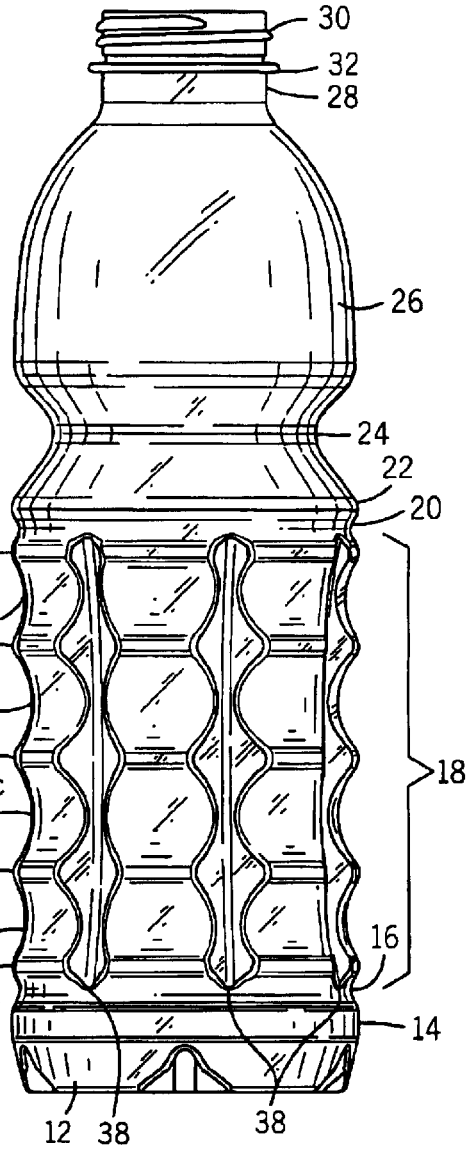
FIG. 3 is a elevational view similar to FIG. 2, except that the bottle is rotated approximately 50° about its vertical axis.

Importantly, the panel section 18 includes a plurality of vertical recessed ribs 38 extending through the gripping rings 34*a–d* and the raised rings 36*a–e* between the lower recessed ring 16 and the upper recessed ring 20. These vertical ribs 38 cause the side panel to have a plurality of vertically-orientated gripper segments 40*a–g*, best seen in FIG. 6. The vertical ribs 36 reduce the radial strength created by the recessed gripper rings 34*a–d* to a degree sufficient to permit the panel section 18 to be squeezably deformed to controllably dispense its contents.

In a significant aspect of the invention, the vertical ribs 38 are spaced circumferentially about the panel section 18 so that none of the vertical ribs 38 is diametrically opposite to any other vertical rib. This lack of symmetry helps to insure that the bottle 10 still has sufficient radial rigidity to withstand the stresses of its anticipated hot-filling and handling.

If the vertical ribs 38 are equally spaced about the circumference of the panel section 18 (as in the illustrated embodiment), there should be an odd number of vertical ribs 38 to insure that none are diametrically opposed. In the illustrated embodiment, there are seven vertical ribs 38. However, the number vertical ribs may be varied so long as the bottle still meets the two criteria of squeezability and rigidity.

Thus, a squeezable bottle that meets the objects of the present invention has been disclosed. While the bottle has been described in terms of a preferred embodiment, there is no intent to limit the invention to the same. Instead, the invention is defined by the scoped of the appended claims.

What is claimed:

1. A squeezable bottle comprising a hollow body with a vertical axis having an intermediate panel section defining a circumference, the intermediate panel section being bounded by an upper recessed reinforcing ring and a lower recessed reinforcing ring, the intermediate panel section comprising a plurality of circumferentially continuous recessed gripper rings, each bounded by a pair a raised reinforcing rings, and a plurality of recessed vertical ribs extending between the upper and lower recessed reinforcing rings and through the raised reinforcing rings, the vertical ribs being spaced asymmetrically about the vertical axis of the body.

2. The squeezable bottle of claim 1 wherein there is an odd number of vertical ribs and the vertical ribs are equally spaced about the circumference of the body.

3. The squeezable bottle of claim 2 wherein the number of vertical ribs is seven.

4. The squeezable bottle of claim 1 wherein the number of gripper rings is four.

* * * * *